US009485825B2

(12) United States Patent
Vaughan

(10) Patent No.: US 9,485,825 B2
(45) Date of Patent: Nov. 1, 2016

(54) ENABLE CIRCUIT FOR LIGHTING DRIVERS

(71) Applicant: Power Integrations, Inc., San Jose, CA (US)

(72) Inventor: Peter Vaughan, Los Gatos, CA (US)

(73) Assignee: Power Integrations, Inc., San Jose, CA (US)

( * ) Notice: Subject to any disclaimer, the term of this patent is extended or adjusted under 35 U.S.C. 154(b) by 195 days.

(21) Appl. No.: 14/536,484

(22) Filed: Nov. 7, 2014

(65) Prior Publication Data

US 2016/0135264 A1 May 12, 2016

(51) Int. Cl.
*H05B 33/08* (2006.01)

(52) U.S. Cl.
CPC ..... *H05B 33/0845* (2013.01)

(58) Field of Classification Search
CPC ..... H05B 33/0845
See application file for complete search history.

(56) References Cited

U.S. PATENT DOCUMENTS

2010/0253657 A1* 10/2010 Tseng ..... H05B 33/0818 345/205
2010/0308749 A1* 12/2010 Liu ..... H05B 33/0815 315/307
2012/0201019 A1* 8/2012 Chung ..... H05B 33/0815 362/184
2015/0189706 A1* 7/2015 Yang ..... H05B 33/083 315/224

* cited by examiner

*Primary Examiner* — Douglas W Owens
*Assistant Examiner* — Pedro C Fernandez
(74) *Attorney, Agent, or Firm* — Blakely Sokoloff Taylor & Zafman LLP

(57) ABSTRACT

This relates to an enable driver circuit for an LED drive. In some examples, the enable driver circuit may sense an input of the LED driver and enable the LED driver when a conduction angle of the input is greater than a threshold value after a set amount of line cycles of the input of the LED driver have occurred. If the conduction angle is not greater than the threshold after the set amount of line cycles, the enable driver circuit may not enable the LED driver and power may not be delivered to the LED load. In some examples, the enable driver circuit may further enable the LED driver if the conduction angle of the input increases by a certain amount and the resultant conduction angle is greater than the threshold, regardless of the number of line cycles of the ac input voltage that have occurred.

26 Claims, 6 Drawing Sheets

ENABLE CIRCUIT FOR LIGHTING DRIVERS

BACKGROUND

1. Field

The present disclosure relates generally to power converters and, more specifically, to power converters utilized with dimmer circuits.

2. Related Art

Residential and commercial lighting applications often include a dimming functionality to provide variable light output. One known technique for providing this function is phase-angle dimming, which may be implemented using either leading-edge or trailing-edge phase-control. A semiconductor switch-based circuit (e.g., TRIAC or MOSFET) is often used to perform this type of phase-angle dimming and operates by delaying the beginning of each half-cycle of alternating current (ac) power or trimming the end of each half-cycle of ac power. By delaying the beginning of each half-cycle or trimming the end of each half-cycle, the amount of power delivered to the load (e.g., the lamp) is reduced, thereby producing a dimming effect in the light output by the lamp.

It is often convenient to designate the position of the TRIAC dimmer circuit and the resultant amount of power delivered to the load in terms of a fraction of the period of the ac input voltage measured in degrees. In general, the ac input voltage is a sinusoidal waveform and the period of the ac input voltage is referred to as a full line cycle. As such, half of the period of the ac input voltage is referred to as a half line cycle. An entire period has 360 degrees, and a half line cycle has 180 degrees. Typically, the phase-angle is a measure of how many degrees (from a reference of zero degrees) of each half line cycle are disconnected by the TRIAC dimmer circuit. For example, removal of half of the ac input voltage in a half line cycle by the TRIAC dimmer circuit corresponds to a phase-angle of 90 degrees. In another example, removal of a quarter of the ac input voltage in a half line cycle may correspond to a phase-angle of 45 degrees. On the other hand, the conduction angle is a measure of how many degrees (from a reference of zero degrees) of each half line cycle that are not disconnected by the TRIAC dimmer circuit. In other words, the conduction angle is a measure of how many degrees of each half line cycle in which the TRIAC dimmer circuit is conducting. In one example, the removal of a quarter of the ac input voltage in a half line cycle may correspond to a phase-angle of 45 degrees and a conduction angle of 135 degrees.

Although phase-angle dimming works well with incandescent lamps that receive the altered ac input voltage directly, it typically creates problems for light emitting diode (LED) lamps that are often driven by regulated power converters. The regulated power converters are used to provide the LED lamps with a regulated current and voltage from the altered ac power line. However, conventional power converters often produce non-ideal results when used with TRIAC dimmer circuits. As a result, flickering or shimmering of the LED lamp can occur at large conduction angles and flashing of the LED lamp can occur at low conduction angles.

BRIEF DESCRIPTION OF THE DRAWINGS

Non-limiting and non-exhaustive embodiments are described with reference to the following figures, wherein like reference numerals refer to like parts throughout the various views unless otherwise specified.

Figure 1:
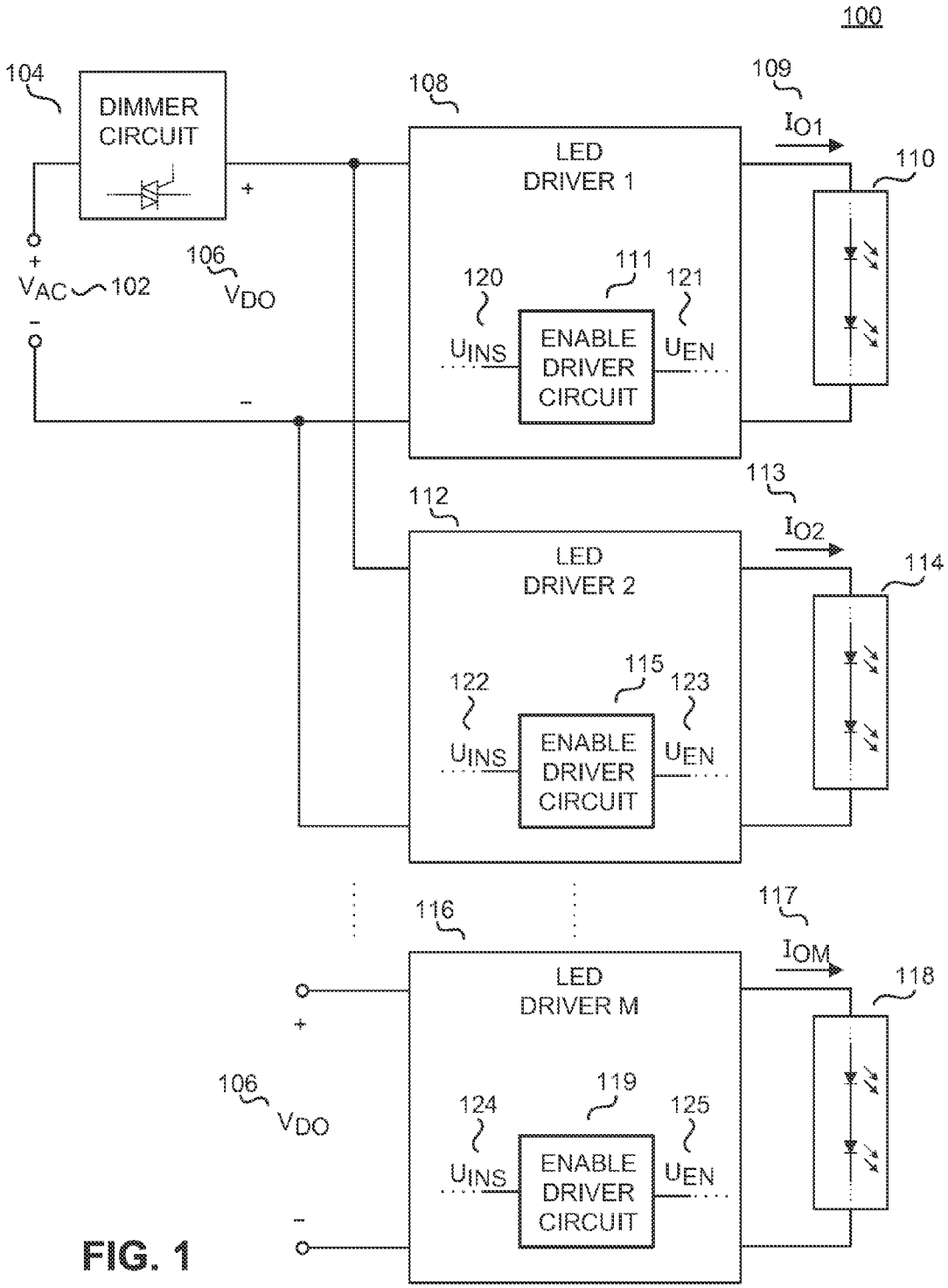
FIG. 1 is a functional block diagram illustrating an example lighting system with a lighting driver utilizing an enable driver circuit according to various examples.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present technology. It will be apparent, however, to one having ordinary skill in the art that the specific detail need not be employed to practice the present technology. In other instances, well-known materials or methods have not been described in detail in order to avoid obscuring the present technology.

Reference throughout this specification to "one embodiment", "an embodiment", "one example", or "an example" means that a particular feature, structure or characteristic described in connection with the embodiment or example is included in at least one embodiment of the present disclosure. Thus, appearances of the phrases "in one embodiment", "in an embodiment", "one example", or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

In general, power is delivered to an LED lamp by an LED driver. The LED driver may include a regulated power converter that provides a regulated current and voltage from the ac power line to the LED lamp. For phase dimming applications, including those for LEDs, a phase dimmer circuit typically disconnects a portion of the ac input voltage at every half line cycle to limit the amount of voltage and current supplied to the LED driver and the LEDs. Typically, the phase-angle is a measure of how many degrees of each half line cycle that are disconnected by the dimmer circuit. Conversely, the number of degrees of each half line cycle of the ac input voltage that the dimmer circuit does not disconnect may be referred to as the conduction angle. In one example, the conduction angle (or phase-angle) may be measured by threshold detection in which the input voltage may be compared to a reference threshold. The amount of time that the input voltage is above a reference threshold may correspond to the conduction angle of the dimmer circuit. Alternatively, the amount of time that the input voltage is below the reference threshold may correspond to the phase-angle.

In some lighting systems, each LED lamp may have its own LED driver. However, each of those LED lamps may be connected to a single dimmer circuit. Although each LED lamp and driver may be connected to the same dimmer circuit, the conduction angle (or phase-angle) sensed by each LED driver may differ due to the variances of component values within each LED driver. As a result, each LED lamp may potentially begin operating at different times or there may be non-uniformity in the amount of illumination provided by each LED lamp.

Embodiments of the present disclosure may utilize an enable driver circuit for each LED driver (also referred to as a lighting driver) to enable or disable the lighting driver from providing power to the LED load. In some examples, the enable driver circuit may sense the input line of the lighting driver and enable the lighting driver to function (e.g., provide power to the LED load) when the conduction angle is greater than a threshold after a set amount of line cycles of the ac input voltage (full or half line cycles). If the conduction angle is not greater than the threshold after the set amount of line cycles, the enable driver circuit may not enable the lighting driver and power may not be delivered to the LED load. In some examples, the enable driver circuit may enable the lighting driver if the conduction angle increases by a certain amount and the resultant conduction angle is greater than the threshold, regardless of the number of line cycles of the ac input voltage that have passed.

Referring first to FIG. 1, a functional block diagram of an example lighting system 100 is illustrated including an ac input voltage $V_{AC}$ 102, a dimmer circuit 104, a dimmer output voltage $V_{DO}$ 106, lighting drivers 108, 112, and 116, output currents $I_{O1}$ 109, $I_{O2}$ 113, and $I_{OM}$ 117, loads 110, 114, and 118, enable driver circuits 111, 115, and 119, input sense signals $U_{INS}$ 120, 122, and 124, and enable signals $U_{EN}$ 121, 123, and 125. Lighting driver 108 is shown as including enable driver circuit 111, while lighting drivers 112 and 116 include enable driver circuits 115 and 119, respectively. While FIG. 1 illustrates three lighting drivers with three separate loads, it should be appreciated that any number of lighting drivers and loads may benefit from the teachings of the present disclosure.

The lighting system 100 provides output power to the loads 110, 114, and 118. As illustrated, the lighting system 100 receives the ac input voltage $V_{AC}$ 102. The dimmer circuit 104 is coupled to receive the ac input voltage $V_{AC}$ 102 and produces the dimmer output voltage $V_{DO}$ 106. The dimmer circuit 104 may be utilized to limit the voltage delivered to the lighting drivers 108, 112, and 116. In one embodiment, the dimmer circuit 104 may be a phase-dimming circuit, such as a TRIAC phase dimmer. For leading-edge dimming, the dimmer circuit 104 disconnects the ac input voltage $V_{AC}$ 102 when the ac input voltage $V_{AC}$ 102 crosses zero voltage. After a given amount of time, the dimmer circuit 104 reconnects the ac input voltage $V_{AC}$ 102 with the lighting driver. The amount of time before the dimmer circuit reconnects the ac input voltage $V_{AC}$ 102 may be set by a user. For trailing-edge dimming, the dimmer circuit 104 connects the input to the power converter when the ac input voltage $V_{AC}$ 102 crosses zero voltage. After a given amount of time that may be set by a user, the dimmer circuit 104 then disconnects the ac input voltage $V_{AC}$ 102 for the remainder of the half cycle. In other words, the dimmer circuit 104 may interrupt the phase of the ac input voltage $V_{AC}$ 102. Depending on the desired amount of dimming, the dimmer circuit 104 controls the amount of time the ac input voltage $V_{AC}$ 102 is disconnected from the power converter. In general, a greater amount of dimming corresponds to a longer period of time during which the dimming circuit 104 disconnects the ac input voltage $V_{AC}$ 102.

The dimmer output voltage $V_{DO}$ 106 may be received by the lighting drivers 108, 112, and 116. Each lighting driver (108, 112, 116) may utilize the received dimmer output voltage $V_{DO}$ 106 to provide power to their respective loads (110, 114, 118). The output provided to the loads 110, 114, 118 are exemplified as output currents $I_{O1}$ 109, $I_{O2}$ 113, and $I_{OM}$ 117. In the example shown, the loads 110, 114, 118 may include an LED lamp, LED array, or LED module. The lighting drivers (108, 112, 116) include the enable driver circuits 111, 115, and 119, respectively. However, it should be appreciated that not every lighting driver of the lighting system 100 may include an enable driver. Each lighting driver (108, 112, and 116) is coupled to receive an input sense signal $U_{INS}$ 120, 122, and 124 that is representative of an input of the respective lighting driver. For example, the input sense signals $U_{INS}$ 120, 122, and 124 may be representative of the ac input voltage $V_{AC}$ 102, the dimmer output voltage $V_{DO}$ 106, or rectified versions of either the ac input voltage $V_{AC}$ 102 or the dimmer output voltage $V_{DO}$ 106. Although each the input sense signal $U_{INS}$ 120, 122, and 124 is representative of the same signal (e.g., ac input voltage $V_{AC}$ 102, the dimmer output voltage $V_{DO}$ 106, or rectified versions of either), the input sense signals $U_{INS}$ 120, 122, and 124 themselves may vary from each other due to the variables in components of their respective lighting drivers.

The enable driver circuits 111, 115 and 119 produce the enable signals $U_{EN}$ 121, 123, and 124 to enable or disable their respective lighting drivers in response to the input sense signal $U_{INS}$ 120, 122, and 124, respectively. In one example, the enable driver circuit (111, 115 or 119) may enable the lighting driver (108, 112, or 116) to provide power to the load (110, 114, or 118) when the conduction angle of the input sense signal ($U_{INS}$ 120, 122, or 124) determined by the enable driver circuit (111, 115 or 119) is greater than a threshold after a set amount of full or half line cycles of the ac input voltage $V_{AC}$ 102. If the conduction angle is not greater than the threshold after the set amount of cycles, the enable driver circuit (111, 115 or 119) may not enable the lighting driver (108, 112, or 116) and power may not be delivered to the LED load. In another example, the enable driver circuit (111, 115 or 119) may enable the lighting driver (108, 112, or 116) if the conduction angle increases by a certain amount and the resultant conduction angle is greater than the threshold regardless of the number of line cycles of the ac input voltage $V_{AC}$ 102 that have passed.

Figure 2:
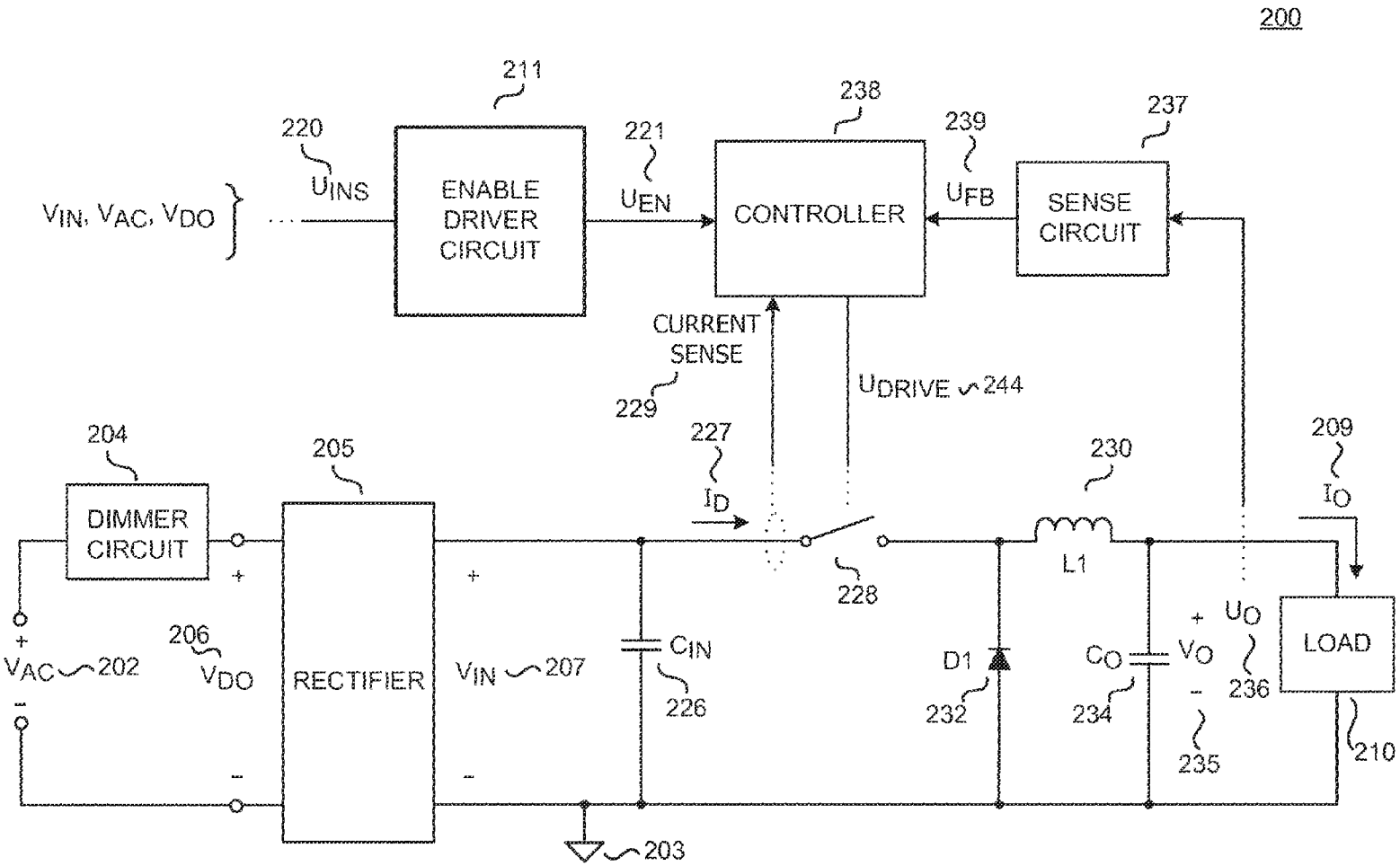
FIG. 2 is a functional block diagram of an example lighting driver utilizing an enable driver circuit for FIG. 1 according to various examples.

FIG. 2 illustrates an example lighting driver 200, ac input voltage $T_{AC}$ 202, dimmer circuit 204, dimmer output voltage $V_{DO}$ 206, and load 210. Lighting driver 200 is one example lighting driver that can be used to implement any of lighting drivers 108, 112, and 116, discussed above. In the illustrated example, the lighting driver 200 includes a rectifier 205, an input capacitor Cm 226, an input return 203, a power switch 228, an energy transfer element 230 (exemplified as an inductor L), a freewheeling diode D1 232, an output capacitor Co 234, a sense circuit 237, a controller 238, and an enable driver circuit 211. Further illustrated in FIG. 2 are an input voltage $V_{IN}$ 207, output current $I_O$ 209, a switch current $I_D$ 227, input sense signal $U_{INS}$ 220, enable signal $U_{EN}$ 221, an output voltage $V_O$ 235, an output quantity $U_O$ 236, a feedback signal $U_{FB}$ 239, a switch current sense signal 229, and a drive signal $U_{DRIVE}$ 244. The output current $I_O$ 209, input sense signal $U_{INS}$ 220, and enable signal $U_{EN}$ 221 may be one example of the output currents, input sense signals, and enable signals discussed above with respect to FIG. 1. The lighting driver 200 illustrated in FIG. 2 is coupled as a non-isolated buck converter. However, other power converter topologies or configurations may benefit from the teachings of the present disclosure. In addition, while the lighting driver 200 is illustrated as a non-isolated power converter (e.g. dc current is able to flow between the input and the output of the lighting driver), it should be appreciated that isolated power converters may also be used. Similarly named and numbered elements couple and function as described above.

The lighting driver 200 provides output power to the load 210 from an unregulated input voltage (e.g., the ac input voltage $T_{AC}$ 202, the dimmer output voltage $V_{DO}$ 206, or the input voltage $V_{IN}$ 207). As shown, dimmer circuit 204 receives the ac input voltage $T_{AC}$ 202 and produces the dimmer output voltage $V_{DO}$ 206. The dimmer circuit 204 may be utilized to limit the voltage delivered to the lighting driver 200. In one example, the dimmer circuit 204 is a phase dimming circuit. For the example of an LED load, when the dimmer circuit 204 limits the amount of voltage delivered, the resultant current delivered to the load of LED arrays may also be limited, thereby causing the LED array to dim. The dimmer circuit 204 further couples to the rectifier 205 and the dimmer output voltage $V_{DO}$ 206 is received by the rectifier 205.

The rectifier 205 rectifies the dimmer output voltage $V_{DO}$ 206 and outputs the input voltage $V_{IN}$ 207. The input capacitor $C_{IN}$ 226 is coupled to the rectifier 205 and filters the high frequency current from the power switch 228. For some applications, the input capacitor $C_{IN}$ 226 may be large enough such that the input voltage $V_{IN}$ 207 is a substantially dc voltage for every line cycle. However, for power supplies with power factor correction (PFC) or for driving an LED load, a small input capacitor $C_{IN}$ 226 may be utilized to allow the input voltage $V_{IN}$ 207 to substantially follow the rectified dimmer output voltage $V_{DO}$ 206 over every line cycle. As such, the enable driver circuit 211 may detect when the dimmer circuit 204 disconnects and reconnects the ac input voltage $T_{AC}$ 202 from the power converter 200 by sensing the input voltage $V_{IN}$ 207. In another example, the enable driver circuit 211 may detect (approximately) when the dimmer circuit 204 disconnects and reconnects the ac input voltage $T_{AC}$ 202 by sensing the switch current $I_D$ 227.

The capacitor $C_{IN}$ 226 is coupled to one end of the power switch 228. The other end of the power switch 228 is coupled to the energy transfer element L1 230 and the freewheeling diode D1 232. Both the energy transfer element L1 230 and freewheeling diode D1 232 are further coupled to the output capacitor $C_O$ 234. An output is provided to the load 210 and may be provided as either a regulated output voltage $V_O$ 235, regulated output current $I_O$ 209, or a combination of the two. In one example, the load 210 may include an LED, an LED module, or an LED array.

The lighting driver 200 further includes circuitry to regulate the output, which is exemplified as output quantity $U_O$ 236. In general, the output quantity $U_O$ 236 is either an output voltage $V_O$ 235, output current $I_O$ 209, or a combination of the two. A sense circuit 237 is coupled to sense the output quantity $U_O$ 236 and to provide feedback signal $U_{FB}$ 239, which is representative of the output quantity $U_O$ 236. Controller 238 is coupled to the sense circuit 237 and receives the feedback signal $U_{FB}$ 239. The controller 238 may further include terminals for receiving enable signal $U_{EN}$ 221, the current sense signal 229, and for providing the drive signal 244 to power switch 228. The current sense signal 229 may be representative of the switch current $I_D$ 227 in the power switch 228. Both the enable signal $U_{EN}$ 221 and the current sense signal 229 may be voltage signals or current signals. Controller 238 provides drive signal 244 to the power switch 228 to control various switching parameters of the power switch 228 to control the transfer of energy from the input to the output of power converter 200. Examples of such parameters may include switching frequency, switching period, duty cycle, respective ON and OFF times of the power switch 228, or varying the number of pulses per unit time of the power switch 228. In one example, the switch 228 may be a transistor such as a metal-oxide-semiconductor field-effect transistor (MOSFET). In another example, controller 238 may be implemented as a monolithic integrated circuit or may be implemented with discrete electrical components or a combination of discrete and integrated components. Controller 238 and power switch 228 can form part of an integrated circuit that is manufactured as either a hybrid or monolithic integrated circuit. In addition, enable driver circuit 211 may be included within the controller 238.

Similar to above, the enable driver circuit 211 receives the input sense signal $U_{INS}$ 220, which may be representative of an input of the lighting driver (e.g., ac input voltage $T_{AC}$ 202, dimmer output voltage $V_{DO}$ 206, or the input voltage $V_{IN}$ 207), and outputs the enable signal $U_{EN}$ 221. The enable signal $U_{EN}$ 221 may be a voltage signal or a current signal and may be a rectangular pulse waveform with varying lengths of logic high and logic low sections. In one example, a logic high value of the enable signal $U_{EN}$ 221 may correspond to an enabled lighting driver and a logic low value may correspond to a disabled lighting driver. As mentioned above, the enable signal $U_{EN}$ 221 may enable/disable the lighting driver 200 from providing power to the load 210 when the conduction angle determined from the input sense $U_{INS}$ 220 is greater than a threshold after a set amount of full or half line cycles of the ac input voltage $V_{AC}$ 202. If the conduction angle is not greater than the threshold after the set amount of cycles, the enable driver circuit 211 may not enable the lighting driver 200. In another example, the enable driver circuit 211 may enable the lighting driver 200 if the conduction angle increases by a certain amount and the resultant conduction angle is greater than the threshold, regardless of the number of line cycles of the ac input voltage $V_{AC}$ 202 that have passed.

In the example illustrated in FIG. 2, the enable signal $U_{EN}$ 221 is received by the controller 238. As such, in one example, the enable signal $U_{EN}$ 221 may enable/disable the controller 238 from controlling the power switch 228. For example, when the controller 238 is disabled, the power switch 228 may not be turned on. In other words, the drive signal 244 is set to turn off the power switch 228. When the controller 238 is enabled, the drive signal $U_{DRIVE}$ 244 may control the turn on and turn off of the power switch 228. In another example (not pictured), the enable signal $U_{EN}$ 221 and the drive signal $U_{DRIVE}$ 244 may be received by a logic gate (e.g., an AND gate) to gate whether the power switch 228 receives the drive signal $U_{DRIVE}$ 244. In a further example (not pictured), the enable driver circuit 211 may disable the lighting driver 200 by bypassing the load 210. In other words, the enable driver circuit 211 may disable the lighting driver 200 by controlling an additional dummy load that shunts the output current $I_O$ 209 from the load 210.

Figure 3:
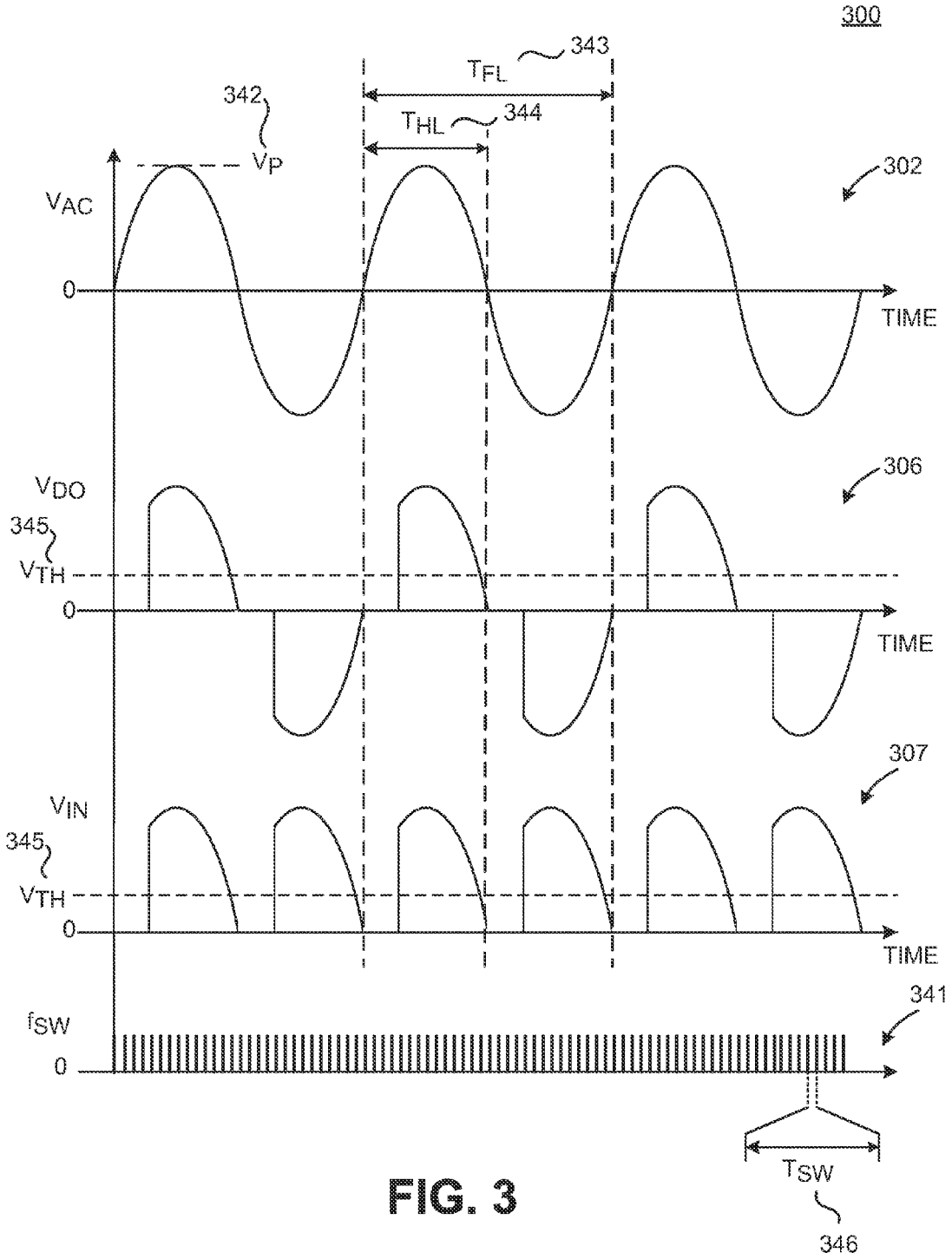
FIG. 3 is a diagram illustrating example waveforms of an ac input voltage, an output voltage of a dimmer circuit, an output of a rectifier circuit, and a system clock of FIG. 1 according to various examples.

FIG. 3 illustrates example waveforms of an ac input voltage 302, a dimmer output voltage $V_{DO}$ 306, an input voltage $V_{IN}$ 307, and a switching clock $f_{SW}$ 341. In particular, FIG. 3 illustrates the dimmer output voltage $V_{DO}$ 306 and the input voltage $V_{IN}$ 307 for leading-edge phase dimming.

In general, the ac input voltage $V_{AC}$ 302 is a sinusoidal waveform having a period that is referred to as a full line cycle $T_{FL}$ 343. Mathematically: $V_{AC}=V_P \sin(2\pi f_L t)$, where $V_P$ 342 is the peak voltage of the ac input voltage $T_{AC}$ 302 and $f_L$ is the frequency of the ac input voltage $T_{AC}$ 302. It should be appreciated that the full line cycle $T_{FL}$ 343 is the reciprocal of the line frequency $f_L$, or mathematically:

$$T_{FL} = \frac{1}{f_L}.$$

As shown in FIG. 3, a full line cycle $T_{FL}$ 343 of the ac input voltage 302 is denoted as the length of time between every other zero-crossing of the ac input voltage 302. Further, the half line cycle $T_{HL}$ 344 is the reciprocal of double the line frequency, or mathematically:

$$T_{HL} = \frac{1}{2f_L}.$$

As shown, the half line cycle $T_{HL}$ 344 of the ac input voltage $V_{AC}$ 302 is denoted as the length of time between consecutive zero-crossings.

For the example of FIG. 3, at the beginning of each half line cycle $T_{HL}$ 344, the dimmer output voltage $V_{DO}$ 306 is substantially equal to zero voltage corresponding to when the dimmer circuit disconnects the ac input voltage $V_{AC}$ 302 from the lighting driver. When the dimmer circuit reconnects the ac input voltage $V_{AC}$ 302 to the lighting driver, the dimmer output voltage $V_{DO}$ 306 substantially follows the ac input voltage $V_{AC}$ 302. Similarly, the input voltage $V_{IN}$ 307 is substantially equal to zero voltage until the dimmer circuit reconnects the ac input voltage $V_{AC}$ 302. Afterwards, the input voltage $V_{IN}$ 307 substantially follows the positive magnitude of the dimmer output voltage $V_{DO}$ 306 and the ac input voltage $V_{AC}$ 302. As shown the dimmer output voltage $V_{DO}$ 306 sharply increases (or decreases) to substantially follow the ac input voltage $V_{AC}$ 302. The sharp increase is also illustrated in the example waveform of the input voltage $V_{IN}$ 307. The sharp increase or decrease may be referred to as the "edge."

The amount of time that the input voltage $V_{IN}$ 307 voltage stays at substantially zero relative to the full line cycle $T_{FL}$ 343 is referred to as the phase-angle and the amount of time that the input voltage $V_{IN}$ 307 follows the positive magnitude of the dimmer output voltage $V_{DO}$ 306 relative to the relative to the full line cycle $T_{FL}$ 343 is referred to as the conduction angle. In one example, the conduction angle may be measured using threshold detection. The line threshold $V_{TH}$ 345 is included in FIG. 3 to illustrate an example threshold that may be utilized to determine the start of every half line cycle and the conduction angle or the phase-angle of the input voltage $V_{IN}$ 307. The amount of time that the input voltage $V_{IN}$ 307 is less than the line threshold $V_{TH}$ 345 may correspond to the measured phase-angle, while the amount of time that the input voltage $V_{IN}$ 307 is greater than the line threshold $V_{TH}$ 345 may correspond to the measured conduction angle. In addition, each time the input voltage $V_{IN}$ 307 crosses the line threshold $V_{TH}$ 345 may correspond to the start of a half line cycle. In one example, the line threshold $V_{TH}$ 345 may be substantially equal to 100 V. Further, the peak voltage $V_P$ 342 may be approximately 400 V. The ratio of the line threshold $V_{TH}$ 345 to the peak voltage $V_P$ 342 may be 1:4.

FIG. 3 also illustrates an example switching clock fsw 341. The switching clock 341 may be a rectangular pulse waveform that pulses to a logic high value and quickly falls to a logic low value. The switching clock 341 may be characterized by its frequency $f_{SW}$ and switching period $T_{SW}$ 346, which is the reciprocal of the frequency $f_{SW}$, or mathematically:

$$T_{SW} = \frac{1}{f_{SW}}.$$

In one example, the switching period $T_{SW}$ 346 may be the length of time between consecutive rising edges of the switching clock 341. It should be appreciated that the switching frequency $f_{SW}$ may be greater than the half line frequency $f_{HL}$ or the full line frequency $f_{FL}$. In other words, the full line cycle $T_{FL}$ 343 and the half line cycle $T_{HL}$ 344 may be greater than the switching period $T_{SW}$ 346. For example, the full line frequency $f_{FL}$ may be substantially equal to 50-60 Hertz (Hz), while the switching frequency $f_{SW}$ may range between 100-132 kHz.

Figure 4:
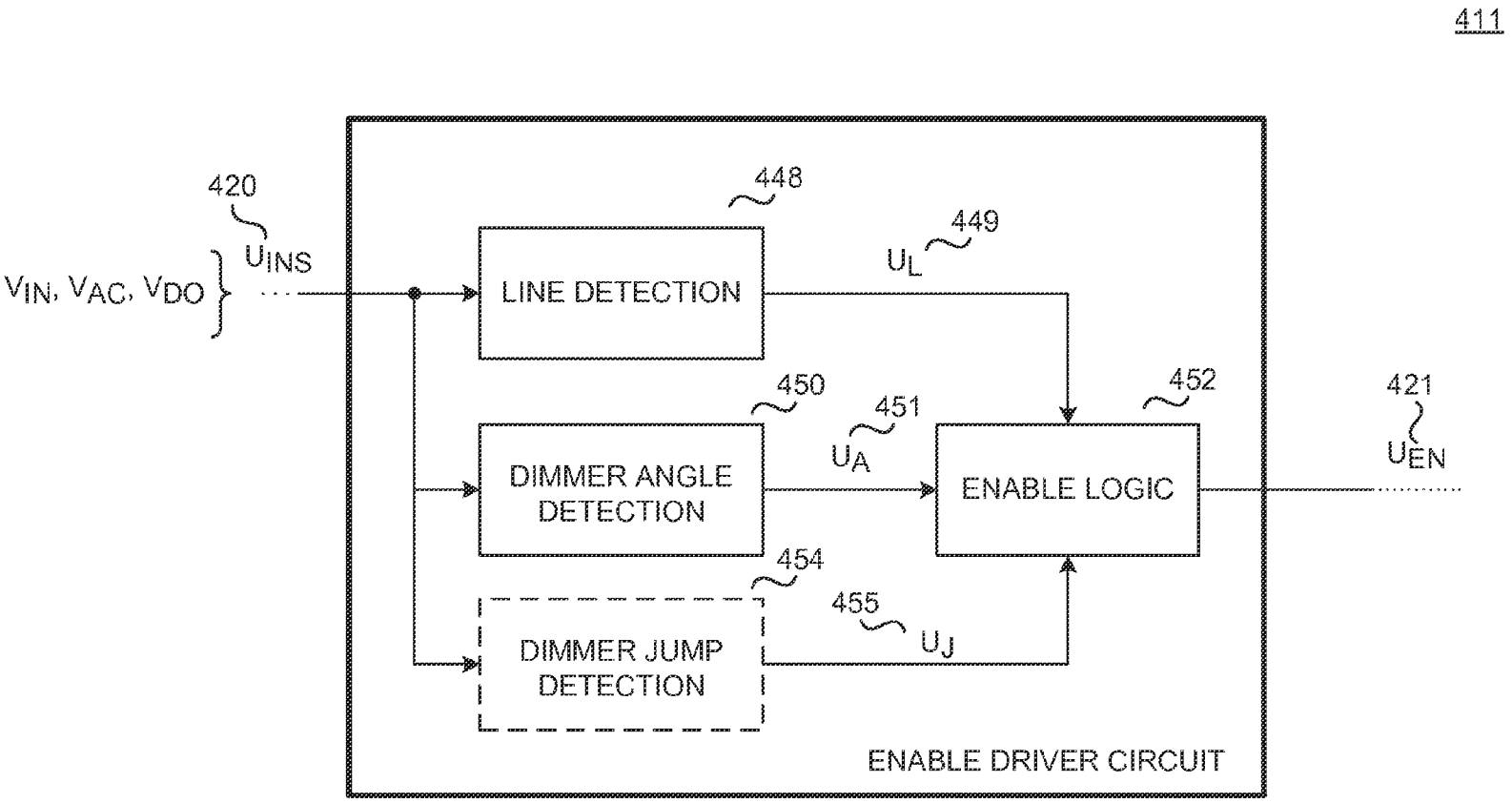
FIG. 4 is a functional block diagram illustrating an example enable driver circuit of FIG. 1 according to various examples.

FIG. 4 illustrates an example enable driver circuit 411, which may be one example of the enable driver circuits 111, 115, 119 and 211. As illustrated, the enable driver circuit 411 includes a line detection block 448, a dimmer angle detection block 450, and an enable logic block 452. Optionally, the enable driver circuit 411 may also include the dimmer jump detection block 454. Further illustrated in FIG. 4 are input sense signal $U_{INS}$ 420, enable signal $U_{EN}$ 421, line signal $U_L$ 449, dimmer angle signal $U_A$ 451, and jump signal $U_J$ 455 (also optional). It should be appreciated that similarly named and numbered elements couple and function as described above.

Line detection block 448 and dimmer angle detection block 450 are coupled to receive the input sense signal $U_{INS}$ 420 (e.g., input sense signal 120, 122, 124, or 220). The line detection block 448 outputs the line signal $U_L$ 449 in response to the input sense signal $U_{INS}$ 420. In one example, the line signal $U_L$ 449 may be a voltage signal or current signal. Further the line signal $U_L$ 449 may be a rectangular pulse waveform with varying lengths of logic high and logic low sections. The line detection block 448 may determine if the number of full line cycles $T_{FL}$ or half line cycles $T_{HL}$ that have occurred are greater than a first threshold. The line detection block 448 conveys that information through the line signal $U_L$ 449 to the enable logic block 452. In one example, the line signal $U_L$ 449 is logic high if the number of full line cycles $T_{FL}$ or half line cycles $T_{HL}$ is greater than the first threshold and logic low otherwise (or vice versa).

Dimmer angle detection block 450 also outputs the dimmer angle signal $U_A$ 451 in response to the input sense signal $U_{INS}$ 420. In one example, the dimmer angle signal $U_A$ 451 may be a voltage signal or current signal. Further the dimmer angle signal $U_A$ 451 may be a rectangular pulse waveform with varying lengths of logic high and logic low sections. The dimmer angle detection block 450 may determine that the conduction angle is greater than a second threshold (or vice versa, that the phase-angle is less than the second threshold). Dimmer angle detection block 450 provides that information through the dimmer angle signal $U_A$ 451 to the enable logic block 452. In one example, the dimmer angle signal $U_A$ 451 may be logic high when the conduction angle is greater than the second threshold and logic low otherwise (or vice versa).

Enable logic block 452 is coupled to receive the line signal $U_L$ 449 and the dimmer angle signal $U_A$ 451 and output the enable signal $U_{EN}$ 421 in response to the received signals. The enable logic block 452 may enable/disable a lighting driver (or controller of a lighting driver) from providing power to an output load. The enable logic block 452 provides that information through the enable signal $U_{EN}$ 421. In one example, a logic high value of the enable signal $U_{EN}$ 421 may correspond to an enabled lighting driver and a logic low value may correspond to a disabled lighting driver. In examples of the present disclosure, enable signal $U_{EN}$ 421 may enable the lighting driver when the line signal $U_L$ 449 indicates that the number of full line cycles $T_{FL}$ or half line cycles $T_{HL}$ that have occurred is greater than the first threshold and the dimmer angle signal $U_A$ 451 indicates that the measured conduction angle is greater than the second threshold. In one example, a minimum of six half line cycles may have occurred before the enable driver circuit 411 may enable the lighting driver (i.e., the first threshold is substantially equal to six). In another example, the second threshold may correspond to a conduction angle of 40 degrees.

The enable driver circuit 411 may also optionally include the dimmer jump detection block 454. As illustrated, the dimmer jump detection block 454 is coupled to receive the input sense signal $U_{INS}$ 420 and output the jump signal $U_J$ 455. In one example, the jump signal $U_J$ 455 may be a voltage signal or current signal. Further the jump signal $U_J$ 455 may be a rectangular pulse waveform with varying lengths of logic high and logic low sections. The dimmer jump detection block 454 may determine if amount that the conduction angle has changed is greater than a third threshold. Further, the change in the conduction angle may be a positive change, or in other words the amount which the conduction angle has increased is greater than the third threshold. The dimmer jump detection block 454 provides that information through the jump signal $U_J$ 455. In one example, a logic high value of the jump signal $U_J$ 455 may correspond to the change in the conduction angle being greater than the third threshold and logic low otherwise (or vice versa). The enable logic 452 may also be coupled to receive the jump signal $U_J$ 455. In one example, the enable logic 452 may output the enable signal $U_{EN}$ 421 to enable a lighting driver when the jump signal $U_J$ 455 indicates that the change in the conduction angle is greater than the third threshold and the dimmer angle signal $U_A$ 451 indicates that the measured conduction angle is greater than the second threshold. In one example, the third threshold may correspond to a 5-10 degrees increase in the conduction angle. Although FIG. 4 illustrates the dimmer jump detection 454 and the dimmer angle detection 450 as separate blocks, it should be appreciated that common components could be shared between the two blocks.

Figure 5A:
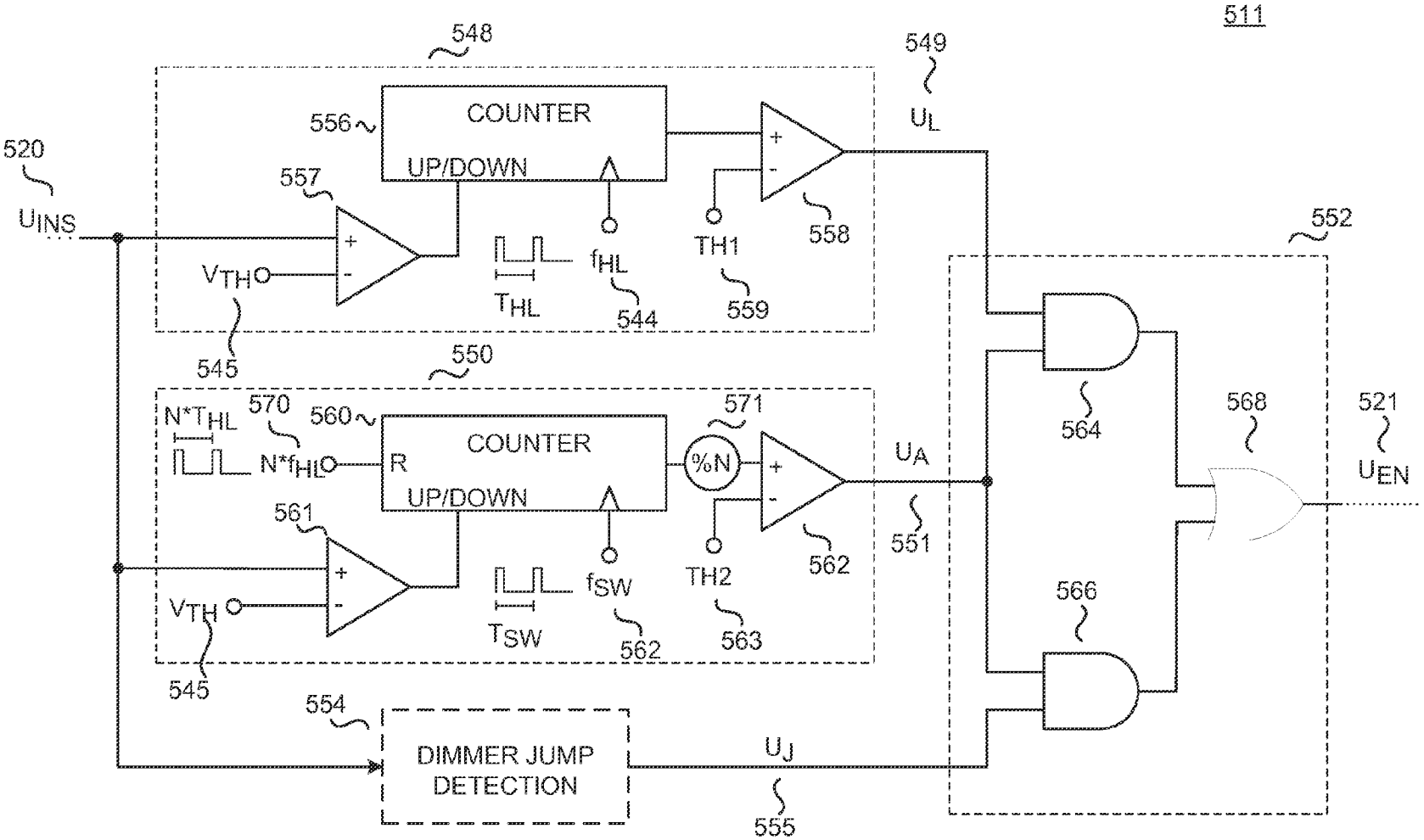
FIG. 5A is a functional block diagram illustrating an example enable driver circuit of FIG. 4 according to various examples.

FIG. 5A illustrates an example enable driver circuit 511, which may be one example of the enable driver circuits 111, 115, 119, 211, and 411. As illustrated, the enable driver circuit 511 includes the line detection block 548, dimmer angle detection block 550, and enable logic block 552. Optionally, the enable driver circuit 511 may also include the dimmer jump detection block 554. The line detection block 548 is illustrated as including a counter 556 and comparators 557 and 558. Dimmer angle detection block 550 is illustrated as including a counter 560, comparators 561 and 562, and divider 571. Enable logic block 552 is shown as including AND gate 564. The enable logic block 552 may also include OR gate 568 and AND gate 566 when a dimmer jump detection block 554 is included. Further illustrated in FIG. 5 are input sense signal $U_{INS}$ 520, enable signal $U_{EN}$ 521, line signal $U_L$ 549, dimmer angle signal $U_A$ 551, jump signal $U_J$ 555, line threshold 545, line cycle clock 544, switching clock 562, first threshold TH1 559, second threshold TH2 563, and half line signal 570. It should be appreciated that similarly named and numbered elements couple and function as described above.

The comparator 557 of the line detection block 548 is illustrated as receiving the input sense signal $U_{INS}$ 520 and the line threshold $V_{TH}$ 545. In the example of FIG. 5, the input sense signal $U_{INS}$ 520 is received at the non-inverting input while the line threshold $V_{TH}$ 545 is received at the inverting input. The output of the comparator 557 is received by counter 556. In particular, the comparator 557 output is received at the UP/DOWN input of the counter 556. The counter 556 also receives the line cycle clock 544 at its CLK input. The line cycle clock 544 may be a rectangular pulse waveform which pulses to a logic high value and quickly falls to a logic low value. The time between rising edges may be substantially equal to the half line cycle $T_{HL}$ of the ac input voltage $T_{AC}$ (as discussed with respect to FIG. 3). Although, it should be appreciated that the time between rising edges may also be substantially equal to the full line cycle $T_L$. The comparator 558 may be coupled to receive the output of the counter 556 and the first threshold TH1 559. As illustrated, the output of the counter 556 is received at the non-inverting input while the first threshold TH1 559 is received at the inverting input. The output of comparator 558 is the line signal $U_L$ 549.

In operation, the input sense signal $U_{INS}$ 520 is compared to the line threshold $V_{TH}$ 545. In one example, the input sense signal $U_{INS}$ 520 may be the rectified dimmer output voltage $V_{DO}$ (e.g., input signal $V_{IN}$). The output of the comparator 557 is logic high when the input sense signal $U_{INS}$ 520 is greater than the line threshold $V_{TH}$ 545. The counter 556 may increment its count value when the received signal at its UP/DOWN input is logic high. In one example, the counter 556 may not increment its count value when the received signal at its UP/DOWN input is logic low. Alternatively, the counter 556 may decrement its count value when the received signal at its UP/DOWN input is logic low. The speed at which the counter 556 increment and/or decrements (e.g., updates) its count value and outputs its count value is responsive to the signal received at its CLK input (e.g., line cycle clock 544). Counter 556 updates when the line cycle clock 544 is logic high. At every half line cycle $T_{HL}$, the line detection block 548 compares the input sense signal $U_{INS}$ 520 to the line threshold $V_{TH}$ 545 and updates the counter 556. Once the output of the counter is greater than the first threshold TH1 559, the line signal $U_L$ 549 transitions to a logic high value indicating that a first threshold TH1 number of half line cycles have occurred. In one example, the first threshold TH1 559 is substantially equal to six.

Dimmer angle detection block 550 includes counter 560 and comparators 561 and 562. The counter 560 and comparators 561 and 562 of the dimmer angle detection block 550 are coupled similarly to the counter 556 and comparators 557 and 558 of the line detection block 548. However, the counter 560 receives the switching clock signal 562 at its CLK input and the divider 571 is coupled between the output of the counter 560 and the input of the comparator 562. In addition, the reset input of the counter 560 is further illustrated as receiving the reset signal 570. As mentioned above, the switching clock signal 562 is a rectangular pulse waveform that increases to a logic high value and quickly decreases to a logic low value. The time between rising edges is substantially equal to the switching period $T_{SW}$. The frequency of the switching clock signal 562 is greater than the frequency of the line clock signal 544 utilized by the line detection block 548. As such, the counter 560 updates faster than the counter 556. In addition, the comparator 562 is illustrated as receiving the second threshold TH2 at one of its inputs (in particular, the inverting input). In addition, the half line cycle 570 may be a rectangular pulse waveform which increases to a logic high value and quickly decreases to a logic low value. The time between rising edges may be substantially equal to a multiple N of the half line cycle $T_{HL}$ of the ac input voltage, or mathematically: $NT_{HL}$ where N may be an integer value. The output of the counter 560 is received by the divider 571. As shown, the divider 571 divides the output of the counter 560 by the multiple N. The divider output signal output of the divider is received by the comparator 562 (as shown, the non-inverting input).

In operation, the input sense signal $U_{INS}$ 520 is compared to the line threshold $V_{TH}$ 545. In one example, the input sense signal $U_{INS}$ 520 may be the rectified dimmer output voltage VDO (e.g., input signal $V_{IN}$). The output of the comparator 561 is logic high when the input sense signal $U_{INS}$ 520 is greater than the line threshold $V_{TH}$ 545. The counter 560 may increment its count value when the received signal at its UP/DOWN input is logic high. In one example, the counter 560 may not increment its count value when the received signal at its UP/DOWN input is logic low. Alternatively, the counter 560 may decrement its count value when the received signal at its UP/DOWN input is logic low. The speed at which the counter 560 increment and/or decrements (e.g., updates) its count value and outputs its count value is responsive to the signal received at its CLK input (e.g., switching clock signal 562). The counter 560 may count for N number of half line cycles ($NT_{HL}$) before being reset. The output of the counter 560 is divided by N by divider 571. As such, the measured conduction angle may be averaged over N number of half line cycles. In general, the dimmer circuit may be asymmetrical and averaging the measured conduction angle may improve the accuracy of the measurement. In one example, the number N may be substantially equal to one or any even integer. Although, it should be appreciated that if N is substantially equal to one, the divider 571 may be omitted.

At every switching period $T_{SW}$, the dimmer angle detection block 550 may compare the input sense signal $U_{INS}$ 520 to the line threshold $V_{TH}$ 545 and update the counter 560. Once the output of the counter is greater than the second threshold TH2 563, the angle signal $U_A$ 551 transitions to a logic high value indicating that the conduction angle is greater than the second threshold TH2 563. In one example, the second threshold TH2 563 is chosen such that the output of the comparator 562 is logic high when the measured conduction angle is greater than 40 degrees. In the example shown in FIG. 5, the conduction angle (or phase-angle) is measured using threshold detection, however other detection methods may also be used. As shown, the counter 560 and comparator 561 may be replaced by other methods of measuring the conduction angle (or phase-angle).

Enable logic block 552 is coupled to receive the line signal $U_L$ 549 and the angle signal $U_A$ 551. Optionally, the enable logic block 552 is also coupled to receive the jump signal $U_J$ 555 from the dimmer jump detection block 554. The dimmer jump detection block 554 couples and functions as described above. As illustrated in FIG. 5, AND gate 564 is coupled to receive the line signal $U_L$ 549 and the angle signal $U_A$ 551, while AND gate 566 is coupled to receive the angle signal $U_A$ 551 and the jump signal $U_J$ 555. The outputs of both AND gates 564 and 566 are received by the OR gate 568. The output of the OR gate is the enable signal $U_{EN}$ 521. In operation, the enable signal $U_{EN}$ 521 does not transition to a logic high value (and therefore enabling the lighting driver) unless either (or both) 1) the line signal $U_L$ 549 and the angle signal $U_A$ 551 are logic high or 2) the angle signal $U_A$ 551 and the jump signal $U_J$ 555 are logic high. It should be appreciated that if the enable driver circuit 511 does not include the dimmer jump detection block 554, the enable logic block 552 may include the AND gate 564 and the enable signal $U_{EN}$ 521 may be the output of the AND gate 564.

Figure 5B:
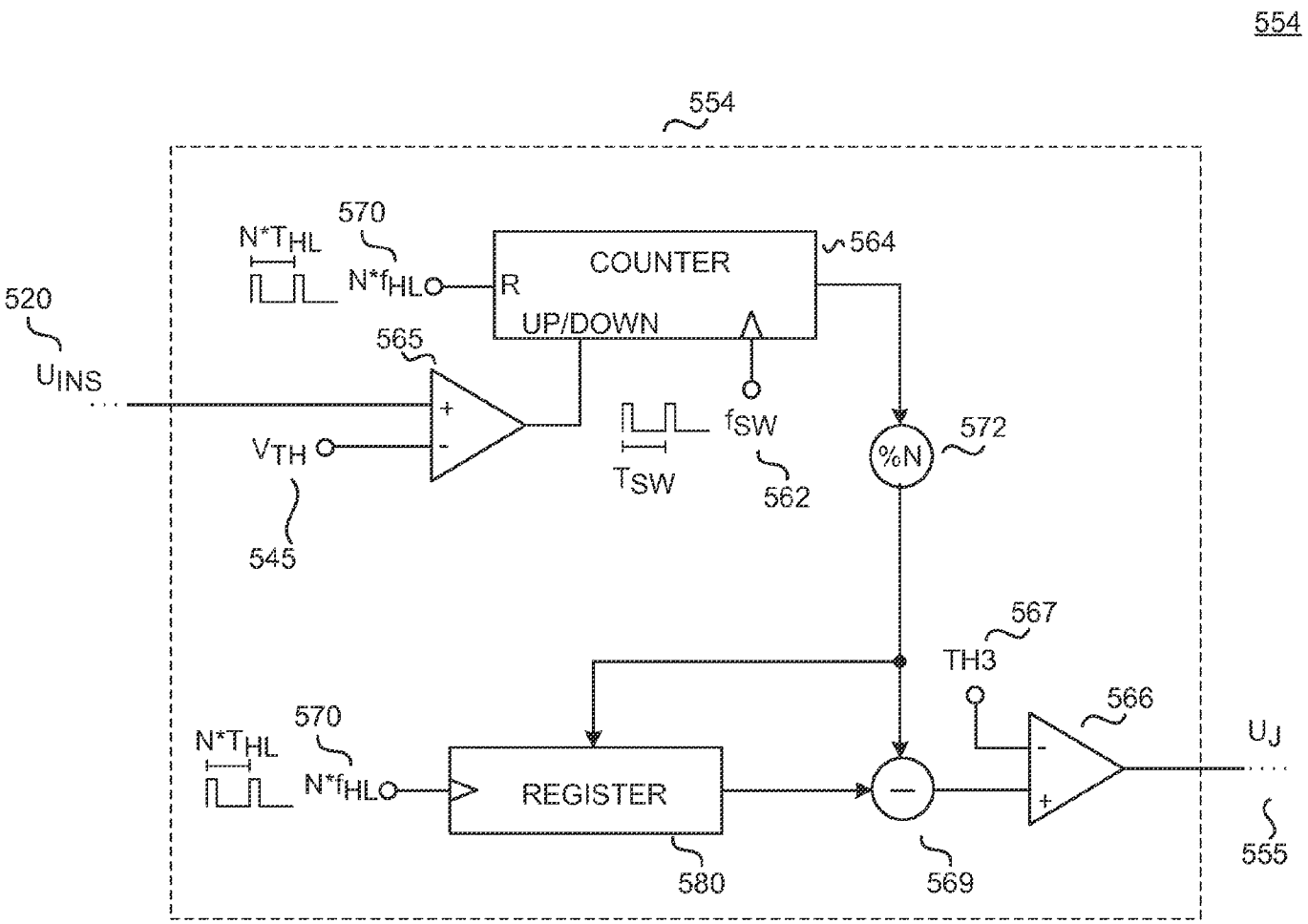
FIG. 5B is a functional block diagram illustrating an example dimmer jump detection block of FIG. 5A according to various examples.

FIG. 5B illustrates an example dimmer jump detection block 554 that may be one example of the dimmer jump detection block 554. The dimmer jump detection block 554 is illustrated as including counter 564, comparators 565 and 566, divider 572, register 580, and arithmetic operator 569. Further illustrated in FIG. 5B are input sense signal $U_{INS}$ 520, line threshold $V_{TH}$ 545, jump signal $U_J$ 555, switching clock $f_{SW}$ 562, third threshold TH3 567, and half line signal 570.

The counter 564, comparator 565, and divider 572 couple and function similarly to the counter 560, comparator 561, and divider 571. It should be appreciated that although dimmer jump detection block 554 is shown as including its own counter 564, comparator 565, and divider 572, the dimmer jump detection block 554 and the dimmer angle detection block 550 could share these components. As such the dimmer jump detection 554 may receive the divided output of the counter 560 shown in FIG. 5A rather than having additional counter 564, comparator 565, and divider 572. The output of the divider 572 is coupled to be received by the register 580 and the arithmetic operator 569. The register 580 is further illustrated as receiving the half line signal 570 at its clock input and the register 580 updates its stored value in response to the half line signal 570. As mentioned above, the time between edges of the half line signal 570 may be a multiple N of the half line cycle $T_{HL}$, where N may be an integer. The stored value within register 580 is output as a register output signal that is received by the arithmetic operator 569. The arithmetic operator may perform arithmetic operations, such as addition, subtraction, multiplication, and division. The comparator 566 is coupled to receive the output of the arithmetic operator 569 (at its inverting input) and the third threshold TH3 567 (at its non-inverting input). In one example, the value used for the third threshold TH3 567 may be the value which an increase between 5-10 degrees in the conduction angle may result in a logic high output of the comparator 566. The output of the comparator 566 is the jump signal $U_J$ 555.

In operation, the input sense signal $U_{INS}$ 520 is compared to the line threshold $V_{TH}$ 545. The counter 564 may increment its count value when the input sense signal $U_{INS}$ 520 is greater than the line threshold $V_{TH}$ 545. The speed at which the counter 564 updates its count value is responsive to the signal received at its CLK input (e.g., switching clock signal 562). The counter 564 may count for N number of half line cycles ($NT_{HL}$) before being reset. The output of the counter 564 is divided by N by divider 572. As such, the measured conduction angle may be averaged over N number of half line cycles.

The averaged output of the counter 564 is received by the register 580 and the arithmetic operator 569. The arithmetic operator performs subtraction to subtract the value stored in the register 580 from the output of the divider 572. In one example, the register 580 stores the previous measured conduction angle (averaged over N number of half line cycles). As such, the arithmetic operator 569 subtracts the current measured conduction angle to the previous measured conduction angle. In one example, the arithmetic operator 569 may perform subtraction by adding the output of the divider 572 with the inverse of the two's complement of the register 580 output. The result of the arithmetic operator 569 is output as an arithmetic operator signal that is compared to the third threshold TH3 567. If the result of the arithmetic operator 569 is greater than the third threshold TH3 567, the jump signal $U_J$ 555 is logic high indicating that the measured conduction angle has increased by the third threshold TH3 567 in a given period of time $N*f_{HL}$ 570.

The register 580 may update its stored value in response to the half line signal 570. It should be appreciated that the subtraction performed by the arithmetic operator 569 occurs prior to the register 580 updating. In addition, the reset of the counter 564 occurs after the register 580 has updated. For example, the counter 564 may reset at the falling edge of the half line signal 570 while the register 580 updates at the rising edge of the half line signal 570.

The above description of illustrated examples of the present invention, including what is described in the Abstract, are not intended to be exhaustive or to be limitation to the precise forms disclosed. While specific embodiments of, and examples for, the invention are described herein for illustrative purposes, various equivalent modifications are possible without departing from the broader spirit and scope of the present invention. Indeed, it is appreciated that the specific example voltages, currents, frequencies, power range values, times, etc., are provided for explanation purposes and that other values may also be employed in other embodiments and examples in accordance with the teachings of the present invention.

What is claimed is:

1. An enable circuit for an LED driver, the enable circuit comprising:

a line detection circuit operable to receive an input sense signal that is representative of an input of the LED driver, wherein the line detection circuit is configured to output a line signal that is representative of a determination of whether a number of detected line cycles of the input sense signal is greater than a first threshold value;

a dimmer angle detection circuit operable to receive the input sense signal, wherein the dimmer angle detection circuit is configured to output a dimmer angle signal that is representative of a determination of whether a conduction angle of the input sense signal is greater than a second threshold value; and an enable logic circuit coupled to receive the line signal and the dimmer angle signal, wherein the enable logic circuit is configured to output an enable signal at a level that enables the LED driver in response to the line signal indicating that the number of detected line cycles of the input sense signal is greater than the first threshold value and the dimmer angle signal indicating that the conduction angle of the input sense signal is greater than the second threshold value.

2. The enable logic circuit of claim 1, wherein the enable logic circuit is further configured to output the enable signal at a level that disables the LED driver in response to the line signal indicating that the number of detected line cycles of the input sense signal is not greater than the first threshold value or the dimmer angle signal indicating that the conduction angle of the input sense signal is not greater than the second threshold value.

3. The enable circuit of claim 1, wherein the line detection circuit comprises:

a first comparator coupled to receive the input sense signal at a non-inverting terminal and a line threshold voltage at an inverting terminal;

a first counter coupled to receive an output of the first comparator at an UP/DOWN terminal and a first clock signal at a clock input terminal, wherein a frequency of the first clock signal corresponds to a frequency of the detected line cycles of the input sense signal; and a second comparator coupled to receive a first count signal output by the first counter at a non-inverting terminal and a first threshold voltage that is representative of the first threshold value at an inverting terminal, wherein the second comparator is coupled to output the line signal.

4. The enable circuit of claim 1, wherein the dimmer angle detection circuit comprises:

a third comparator coupled to receive the input sense signal at a non-inverting terminal and a line threshold voltage at an inverting terminal;

a second counter coupled to receive an output of the first comparator at an UP/DOWN terminal, a second clock signal at a clock input terminal, and a half-line cycle signal at a reset terminal, wherein a frequency of the second clock signal corresponds to a switching frequency of the LED driver, and wherein a frequency of the half-line cycle signal corresponds to an integer multiple of a frequency of the detected line cycles of the input sense signal;

a first divider circuit coupled to receive a second count signal output by the second counter, wherein the first divider circuit is configured to output a first divider signal representative of a value of the second count signal divided by the integer; and a fourth comparator coupled to receive the first divider signal at a non-inverting terminal and a second threshold voltage representative of the second threshold value at an inverting terminal, wherein the fourth comparator is coupled to output the dimmer angle signal.

5. The enable logic circuit of claim 1, wherein the enable logic circuit comprises a first AND gate coupled to receive the line signal and the dimmer angle signal, and wherein the first AND gate is coupled to output the enable signal.

6. The enable circuit of claim 1, further comprising a dimmer jump detection circuit coupled to receive the input sense signal, wherein the dimmer jump detection circuit is configured to output a jump signal that is representative of a determination of whether the conduction angle of the input sense signal has changed by more than a third threshold value.

7. The enable logic circuit of claim 6, wherein the enable logic circuit is further coupled to receive the jump signal, and wherein the enable logic circuit is further configured to output the enable signal at the level that enables the LED driver in response to the dimmer angle signal indicating that the conduction angle of the input sense signal is greater than the second threshold value and the jump signal indicating that the conduction angle of the input sense signal has changed by more than the third threshold value.

8. The enable logic circuit of claim 7, wherein the enable logic circuit is further configured to output the enable signal at a level that disables the LED driver in response to:

the dimmer angle signal indicating that the conduction angle of the input sense signal is not greater than the second threshold value; or the line signal indicating that the number of detected line cycles of the input sense signal is not greater than the first threshold value and the jump signal indicating that the conduction angle of the input sense signal has not changed by more than the third threshold value.

9. The enable circuit of claim 6, wherein the dimmer jump detection circuit comprises:

a fifth comparator coupled to receive the input sense signal at a non-inverting terminal and a line threshold voltage at an inverting terminal;

a third counter coupled to receive an output of the first comparator at an UP/DOWN terminal, a second clock signal at a clock input terminal, and a half-line cycle signal at a reset terminal, wherein a frequency of the third clock signal corresponds to a switching frequency of the LED driver, and wherein a frequency of the half-line cycle signal corresponds to an integer multiple of a frequency of the detected line cycles of the input sense signal;

a second divider circuit coupled to receive a third count signal output by the third counter, wherein the second divider circuit is configured to output a second divider signal representative of a value of the third count signal divided by the integer;

a register coupled to receive the second divider signal and the half-line cycle signal, wherein the register is coupled to output a register output signal;

an arithmetic operator circuit coupled to receive the second divider signal and the register output signal, wherein the arithmetic operator circuit is coupled to output an arithmetic operator signal representative of a difference between the second divider signal and the register signal; and a sixth comparator coupled to receive the arithmetic operator signal at a non-inverting terminal and a third threshold voltage representative of the third threshold value at an inverting terminal, wherein the sixth comparator is coupled to output the jump signal.

10. The enable logic circuit of claim 9, wherein the enable logic circuit comprises:

a first AND gate coupled to receive the line signal and the dimmer angle signal;

a second AND gate coupled to receive the dimmer angle signal and the jump signal; and an OR gate coupled to receive an output of the first AND gate and an output of the second AND gate, wherein the OR gate is coupled to output the enable signal.

11. A lighting system comprising:

a dimmer circuit coupled to receive an ac input voltage and output a dimmer output voltage; and a first LED driver coupled to receive the dimmer output voltage, wherein the first LED driver comprises a first enable driver circuit, and wherein the first enable driver circuit is:

coupled to receive a first input sense signal; and configured to enable the first LED driver in response to a number of detected line cycles of the first input sense signal being greater than a first threshold value and a conduction angle of the first input sense signal being greater than a second threshold value.

12. The lighting system of claim 11, wherein the first enable driver circuit is further configured to disable the first LED driver in response the number of detected line cycles of the first input sense signal not being greater than the first threshold value or the conduction angle of the first input sense signal not being greater than the second threshold value.

13. The lighting system of claim 11, wherein the first enable driver circuit is further configured to enable the first LED driver in response to the conduction angle of the first input sense signal being greater than the second threshold value and the conduction angle of the first input sense signal changing by more than a third threshold value.

14. The lighting system of claim 13, wherein:

the first enable driver circuit is further configured to disable the first LED driver in response to:

the conduction angle of the first input sense signal not being greater than the second threshold value; or the number of detected line cycles of the first input sense signal not being greater than the first threshold value and the conduction angle of the first input sense signal not changing by more than the third threshold value.

15. The lighting system of claim 11, wherein the first enable circuit comprises:

a first line detection circuit coupled to receive the first input sense signal, wherein the first line detection circuit is configured to output a first line signal that is representative of a determination of whether the number of detected line cycles of the first input sense signal is greater than the first threshold value;

a first dimmer angle detection circuit coupled to receive the first input sense signal, wherein the first dimmer angle detection circuit is configured to output a first dimmer angle signal that is representative of a determination of whether the conduction angle of the first input sense signal is greater than the second threshold value; and a first enable logic circuit coupled to receive the first line signal and the first dimmer angle signal, wherein the first enable logic circuit is coupled to output a first enable signal at a level that enables the first LED driver in response to the first line signal indicating that the number of detected line cycles of the first input sense signal is greater than the first threshold value and the first dimmer angle signal indicating that the conduction angle of the first input sense signal is greater than the second threshold value.

16. The lighting system of claim 11, further comprising:

a second LED driver coupled to receive the dimmer output voltage, wherein the second LED driver comprises a second enable driver circuit, and wherein the second enable driver circuit is:

coupled to receive a second input sense signal; and configured to enable the second LED driver in response to a number of detected line cycles of the second input sense signal being greater than the first threshold value and a conduction angle of the second input sense signal being greater than the second threshold value.

17. The lighting system of claim 16, wherein the second enable driver circuit is further configured to disable the second LED driver in response the number of detected line cycles of the second input sense signal not being greater than the first threshold value or the conduction angle of the second input sense signal not being greater than the second threshold value.

18. The lighting system of claim 16, wherein the second enable driver circuit is further configured to enable the second LED driver in response to the conduction angle of the second input sense signal being greater than the second threshold value and the conduction angle of the second input sense signal changing by more than a third threshold value.

19. The lighting system of claim 18, wherein the second enable driver circuit is further configured to disable the second LED driver in response to:

the conduction angle of the second input sense signal not being greater than the second threshold value; or the number of detected line cycles of the second input sense signal not being greater than the first threshold value and the conduction angle of the second input sense signal not changing by more than the third threshold value.

20. The lighting system of claim 16, further comprising:

an LED load coupled to an output of the first LED driver; and a second LED load coupled to an output of the second LED driver.

21. The lighting system of claim 16, wherein the first input sense signal and the second input sense signal are representative of the ac input voltage.

22. The lighting system of claim 16, wherein the first input sense signal and the second input sense signal are representative of the dimmer output voltage.

23. The lighting system of claim 16, wherein the first input sense signal and the second input sense signal are representative of a rectified version of the ac input voltage or the dimmer output voltage.

24. The lighting system of claim 16, wherein the second enable circuit comprises:

a second line detection circuit coupled to receive the second input sense signal, wherein the second line detection circuit is configured to output a second line signal that is representative of a determination of whether the number of detected line cycles of the second input sense signal is greater than the first threshold value;

a second dimmer angle detection circuit coupled to receive the second input sense signal, wherein the second dimmer angle detection circuit is configured to output a second dimmer angle signal that is representative of a determination of whether the conduction angle of the second input sense signal is greater than the second threshold value; and a second enable logic circuit coupled to receive the second line signal and the second dimmer angle signal, wherein the second enable logic circuit is coupled to output a second enable signal at a level that enables the second LED driver in response to the second line signal indicating that the number of detected line cycles of the second input sense signal is greater than the first threshold value and the second dimmer angle signal indicating that the conduction angle of the second input sense signal is greater than the second threshold value.

25. A method for enabling an LED driver, the method comprising:

receiving an input sense signal representative of an input of the LED driver;

determining whether a number of detected line cycles of the input sense signal is greater than a first threshold value;

determining whether a conduction angle of the input sense signal is greater than a second threshold value; and enabling the LED driver in response to a determination that the number of detected line cycles of the input sense signal is greater than the first threshold value and a determination that the conduction angle of the input sense signal is greater than the second threshold value.

26. A method of claim 25 further comprising:

determining whether the conduction angle of the input sense signal has changed by more than a third threshold value; and enabling the LED driver in response to a determination that the conduction angle of the input sense signal has changed by more than the third threshold value and a determination that the conduction angle of the input sense signal is greater than the second threshold value.

* * * * *